US008330372B2

(12) United States Patent
Kang et al.

(10) Patent No.: US 8,330,372 B2
(45) Date of Patent: Dec. 11, 2012

(54) SLOW WAVE STRUCTURES USING TWISTED WAVEGUIDES FOR CHARGED PARTICLE APPLICATIONS

(75) Inventors: Yoon W. Kang, Knoxville, TN (US); Aly E. Fathy, Knoxville, TN (US); Joshua L. Wilson, Knoxville, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 435 days.

(21) Appl. No.: 12/784,571

(22) Filed: May 21, 2010

(65) Prior Publication Data

US 2011/0285479 A1 Nov. 24, 2011

(51) Int. Cl.
*H01J 23/26* (2006.01)

(52) U.S. Cl. ..... 315/5.41; 315/500; 315/505; 333/242

(58) Field of Classification Search ..... 333/239, 333/241, 242; 315/5.41, 500, 505
See application file for complete search history.

(56) References Cited

U.S. PATENT DOCUMENTS 2,541,843 A * 2/1951 Tiley ..... 315/3.6
4,710,736 A * 12/1987 Stidwell ..... 333/241
7,190,860 B2 3/2007 Montgomery et al.

OTHER PUBLICATIONS

Zhong Shi-Cai, Microwave Tuning of Disk-Loaded Waveguide for BEPC, 1987, 802-803, IEEE, Institute of High Energy Physics, Beijing, PRC.

* cited by examiner

*Primary Examiner* — Benny Lee
(74) *Attorney, Agent, or Firm* — Luedeka Neely Group, P.C.

(57) ABSTRACT

A rapidly twisted electromagnetic accelerating structure includes a waveguide body having a central axis, one or more helical channels defined by the body and disposed around a substantially linear central axial channel, with central portions of the helical channels merging with the linear central axial channel. The structure propagates electromagnetic waves in the helical channels which support particle beam acceleration in the central axial channel at a phase velocity equal to or slower than the speed of light in free space. Since there is no variation in the shape of the transversal cross-section along the axis of the structure, inexpensive mechanical fabrication processes can be used to form the structure, such as extrusion, casting or injection molding. Also, because the field and frequency of the resonant mode depend on the whole structure rather than on dimensional tolerances of individual cells, no tuning of individual cells is needed. Accordingly, the overall operating frequency may be varied with a tuning/phase shifting device located outside the resonant waveguide structure.

12 Claims, 9 Drawing Sheets

(Section A-A)

(Section B-B)

(Section C-C)

(Section E-E)

(Section C-C)

(Section D-D)

SLOW WAVE STRUCTURES USING TWISTED WAVEGUIDES FOR CHARGED PARTICLE APPLICATIONS

GOVERNMENT RIGHTS

This invention was made with government support under Contract No. DE-AC05-00OR22725 awarded by the U.S. Department of Energy. The government has certain rights in the invention.

FIELD

This invention relates to the field of slow wave structures for charged particle applications. More particularly, this invention relates to twisted waveguide structures.

BACKGROUND

Radio-frequency (RF) waveguides are used in various applications involving interactions between RF fields and particle beams. One important use of waveguide structures in science and industrial applications is charged particle acceleration. RF resonant cavities are constructed to develop very high electric fields in the gap where the gap field is matched to the speed of the particles. Since the speed of the charged particles is almost equal to or slower than the speed of light, a "slow wave" structure is needed. A regular straight hollow waveguide supports only a "fast wave" whose phase velocity is greater than the speed of light.

Prior slow-wave structures used in accelerating cavity applications have been constructed as multi-cell, disk-loaded structures having corrugations along the beam-axis. These structures generally consist of many small, individually-machined parts which are assembled using expensive welding or brazing processes. Since each cell in the structure must resonate at a specified frequency, each cell must be individually tuned, which is also an expensive and time-consuming process.

What is needed, therefore, is a particle beam accelerating cavity structure which is inexpensive to manufacture and which does not require tuning of individual resonate cell structures.

SUMMARY OF THE INVENTION

The above and other needs are met by a rapidly twisted waveguide structure having a certain cross-section and helical pitch that supports electromagnetic wave propagation at a phase velocity equal to or slower than the speed of light in free space. There are several advantages of the use of twisted waveguide structures as particle beam accelerating cavities:

- Since there is no variation in the shape of the transversal cross-section along the axis of the structure, inexpensive mechanical fabrication processes can be used to form the structure, such as extrusion, casting or molding;
- Since the field and frequency of the resonant mode depend on the whole structure rather than on dimensional tolerances of individual cells, no tuning of individual cells is needed;
- Twisted waveguide structures can be used in both normal conducting systems and superconducting systems;
- The overall operating frequency of the RF field may be varied with a tuning/phase shifting device located outside the resonant waveguide structure; and

- Higher-order modes (HOMs) that are harmful for accelerating particles can be easily damped outside the structure.

Preferred embodiments provide an electromagnetic waveguide structure comprising a waveguide body in which channels are defined by the body. One or more helical channels are disposed about a central axis, and a substantially linear central axial channel disposed along the central axis, where central portions of the one or more helical channels merge with the linear central axial channel. The one or more helical channels are operable to support electromagnetic wave propagation in at least one propagation mode and the central axial channel is operable to conduct a charged particle beam through the waveguide structure.

In some embodiments, the helical channels are disposed at a substantially equiangular spacing around the central axis in a plane transverse to the central axis. The channels may have a substantially elliptically-shaped cross-section or a cross-section shaped as a section of a circle in the plane transverse to the central axis.

In some embodiments, a straight waveguide section is attached to one or both ends of the central axial channel. A power coupler which is aligned substantially perpendicular to the central axis may be connected to this straight waveguide section.

In some embodiments, a rectangular waveguide section is attached at opposing ends of the central axial channel. This rectangular waveguide section may contain a phase-shifter, a power coupler, or a higher-order mode damper.

BRIEF DESCRIPTION OF THE DRAWINGS

Further advantages of the invention are apparent by reference to the detailed description in conjunction with the figures, wherein elements are not to scale so as to more clearly show the details, wherein like reference numbers indicate like elements throughout the several views, and wherein.

DETAILED DESCRIPTION OF THE INVENTION

Figure 1B:
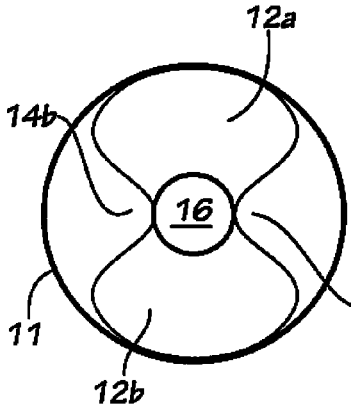
FIG. 1B depicts a transverse cross-section view, taken along line A-A, of the twisted waveguide structure according to the first embodiment.
Figure 1A:
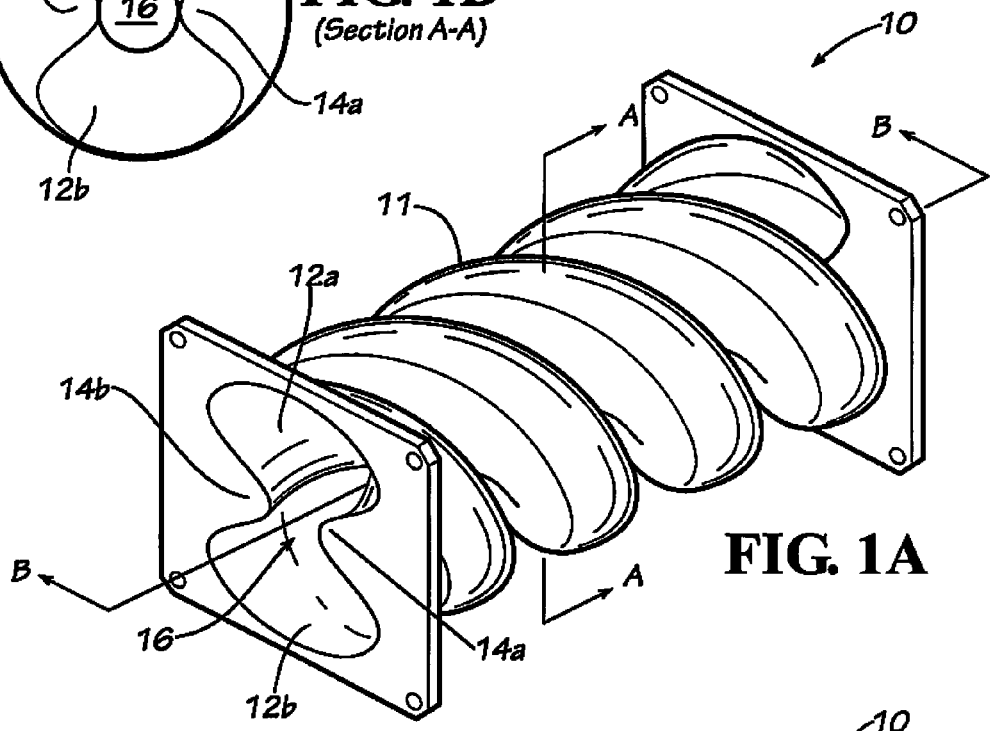
FIG. 1A depicts a perspective view of a twisted waveguide structure according to a first embodiment.
Figure 1C:
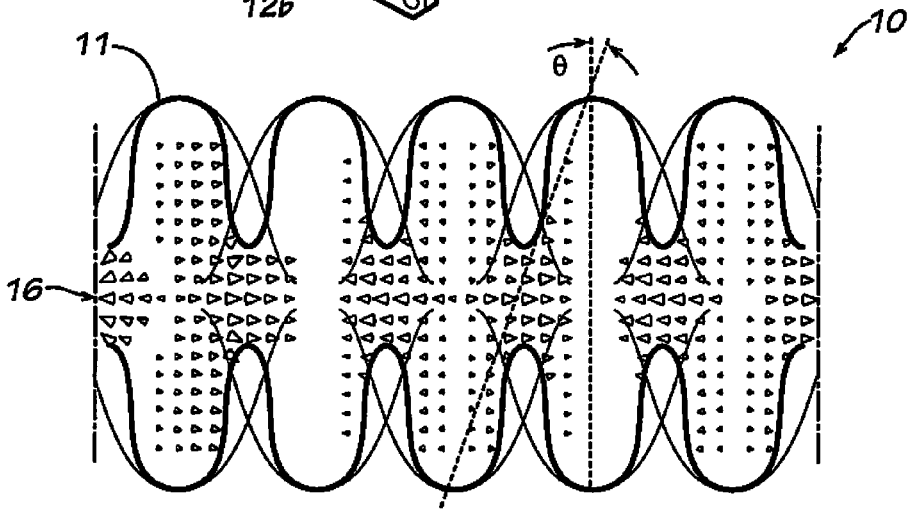
FIG. 1C depicts a longitudinal cross-section view, taken along line B-B, of the twisted waveguide structure according to the first embodiment.

FIGS. 1A, 1B and 1C depict various views of a first embodiment of a twisted waveguide structure 10. In this embodiment, a waveguide body 11 defines two opposing helical channels 12*a*-12*b* (FIGS. 1A, 1B) which merge along the central axis of the structure to form a central axial channel 16. As shown in the cross-section view of FIG. 1B, the channels 12*a*-12*b* are nearly elliptically shaped in a direction transverse to the central axis. The channels 12*a*-12*b* are separated by opposing lobe structures 14*a*-14*b*. As shown in FIG. 1C, the structure 10 forms a corrugated pattern of grooves and ridges in the longitudinal cross-section. The pitch of this corrugated pattern may be characterized by a pitch angle θ as shown in FIG. 1C or by a pitch rate expressed in revolutions per meter (R/m) for example.

Although the invention is not limited to any particular theory of operation, it has been determined that a twisting waveguide, such as the helical structures described herein, effectively increases the path length of propagation of the electromagnetic wave energy traveling through the structure. Increased volume of the space occupied by the electromagnetic wave energy also results in increased propagation delay. The central axial channel 16 remains open as a circular aperture along the longitudinal axis through which the particle beam may pass. The speed of the electromagnetic wave propagation is determined at least in part by the cross sectional shape and twist rate (pitch) of the structure.

Figure 10:
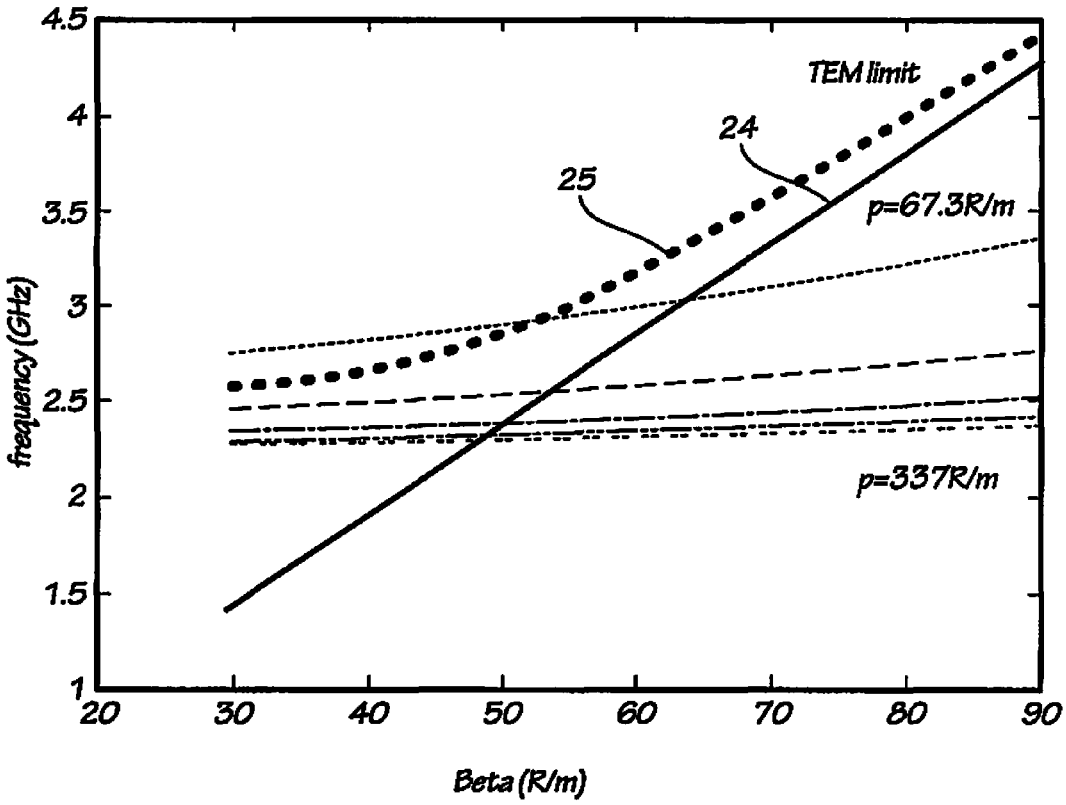
FIG. 10 depicts predicted dispersion curves for twisted waveguide structures having various twist rates compared to the free-space propagation.

FIG. 10 depicts predicted dispersion curves for a twisted waveguide structure. These results, which are plotted in a frequency (in GHZ)-versus-phase, β (in R/m) diagram ($\beta=2\pi/\lambda$, where λ is the free-space wavelength), are calculated using computer simulations which apply a two-dimensional frequency domain method. The straight line 24 represents a limit at which the speed of the transverse electromagnetic (TEM) wave propagation equals the speed of light in free space. The curves crossing the TEM limit 24 represent various pitch rates, p, expressed in revolutions per meter (R/m) ranging from 67.3 R/m to 337 R/m, where the wave propagation is faster than the speed of light on the left side of the TEM limit 24 (with slow twist) and slower than the speed of light on the right side of the TEM limit 24 (with faster twist). The curve for a straight waveguide 25 stays on the left side of the line 24. The simulation results indicate how the pitch of the waveguide twist affects the speed of wave propagation in the twisted guide.

Figure 2A:
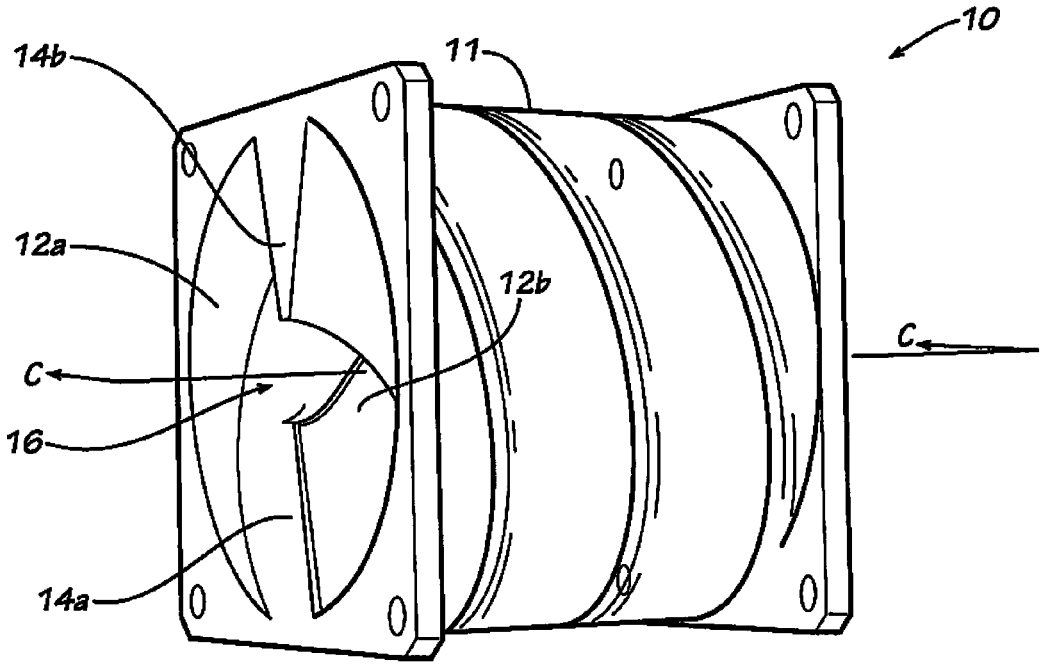
FIG. 2A depicts a perspective view of a twisted waveguide structure according to a second embodiment.
Figure 2B:
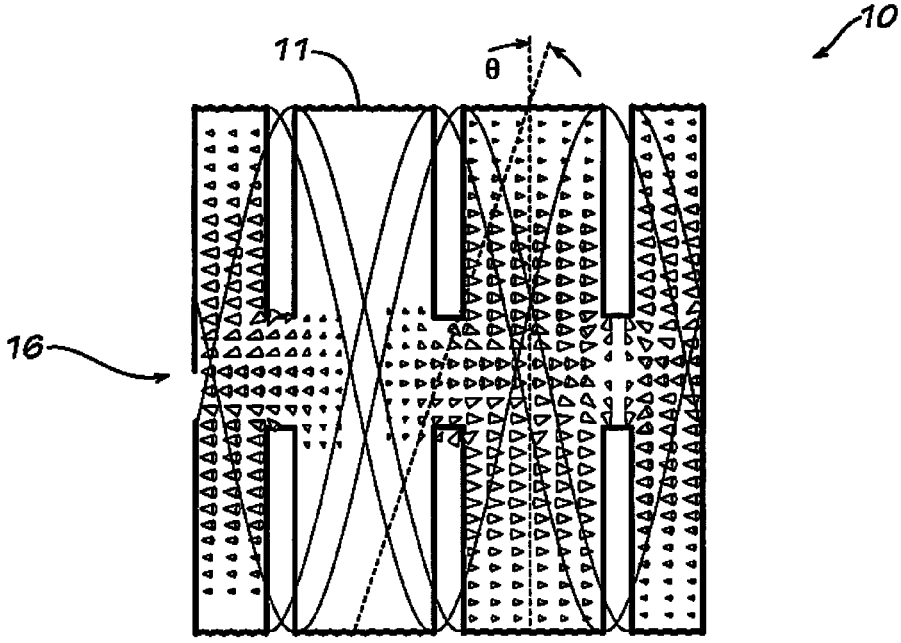
FIG. 2B depicts a longitudinal cross-section view, taken along line C-C, of the twisted waveguide structure according to the second embodiment.
Figure 3:
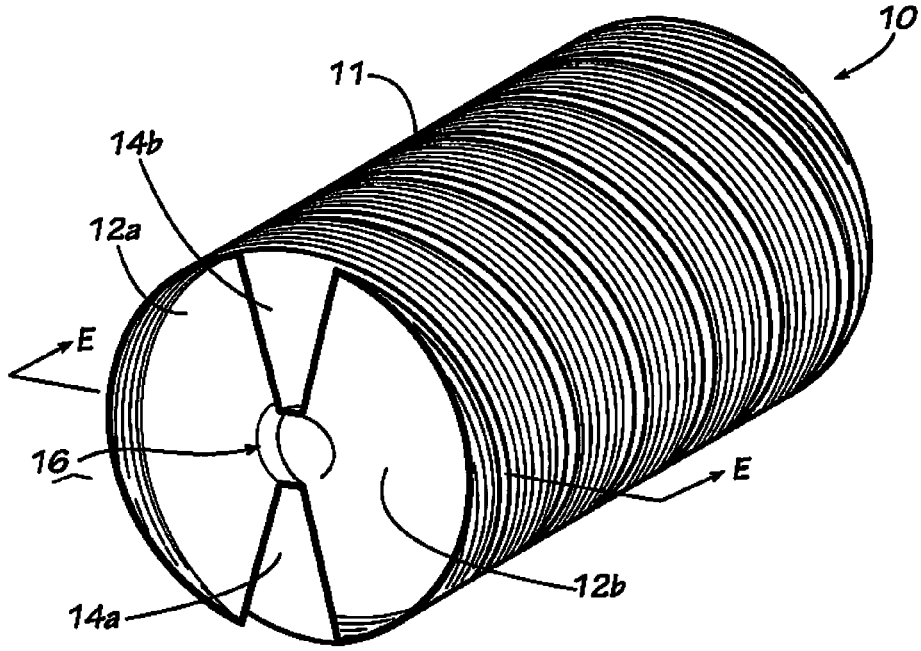
FIG. 3 depicts another perspective view of a twisted waveguide structure according to the second embodiment.
Figure 4A:
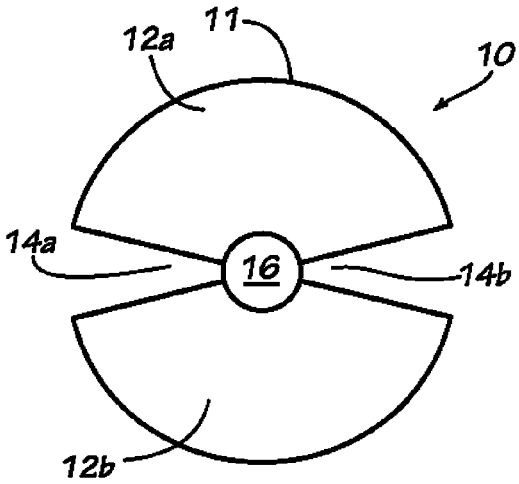
FIG. 4A depicts a transverse cross-section view of the twisted waveguide structure according to the second embodiment.
Figure 4B:
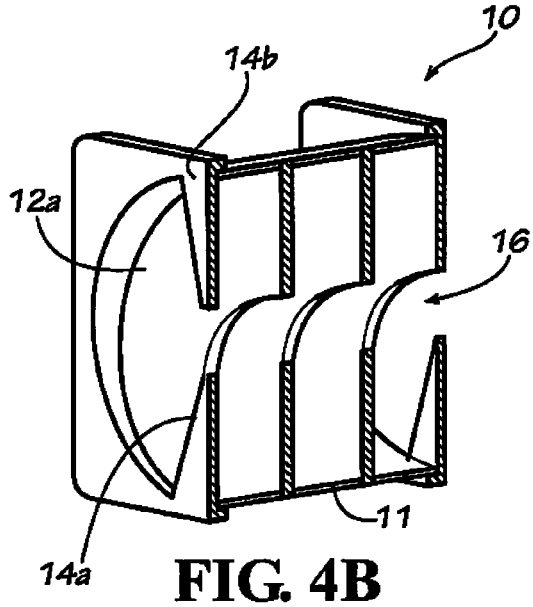
FIG. 4B depicts a perspective longitudinal cross-section view of the twisted waveguide structure according to the second embodiment.

Generally, the lowest order Transverse Magnetic (TM) mode is the most efficient mode for particle acceleration. Actually, the TM-modes in a twisted waveguide structure are more accurately described as "TM-like-modes" as they are not true TM-modes in the conventional mathematical coordinate system. The longitudinal component of the electric field of the TM-like-mode wave in the central axial channel 16 is very similar to that of a true TM-mode wave, and this TM-like-mode wave can accelerate particles at a velocity that is matched to the wave propagation. Although an infinite number of modes exist in any accelerating structure, the specific accelerating mode electric field is almost the strongest near the center of the structure. The larger triangles near the center of the axial channel 16 in the field strength representations in FIGS. 1C and 2B show this. Generally, the quality factor, Q, of the structure determines the strength of the accelerating field. Computer simulations and laboratory measurements have confirmed that the accelerating field strength in a twisted waveguide is comparable to the field strength in a conventional structure.

Figure 6A:
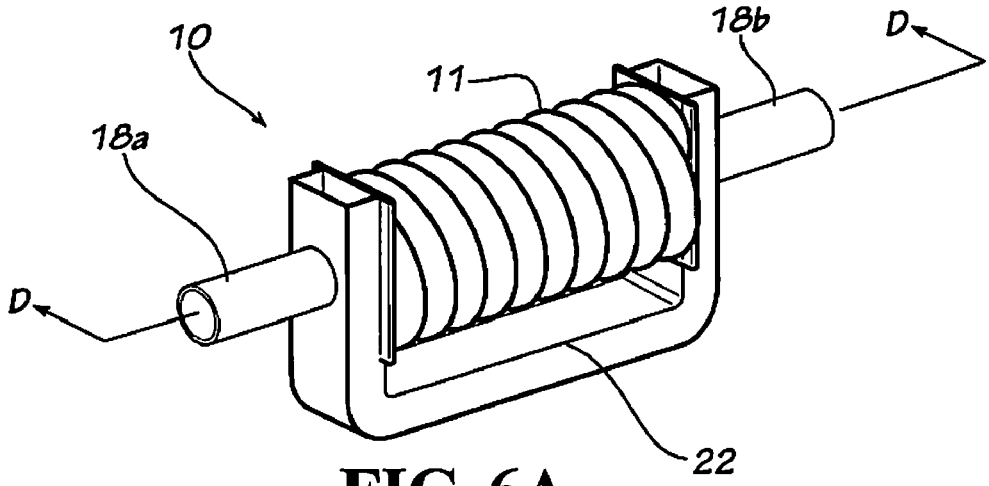
FIG. 6A depicts a perspective view of a non-twisted waveguide connected at each end of a twisted waveguide structure according to an embodiment of the invention.
Figure 6B:
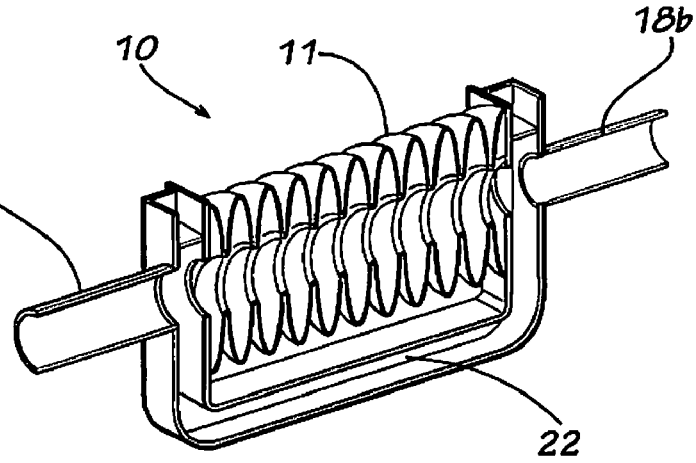
FIG. 6B depicts a perspective longitudinal cross-section view, taken along line D-D, of a non-twisted waveguide connected at each end of a twisted waveguide structure according to an embodiment of the invention.
Figure 6C:
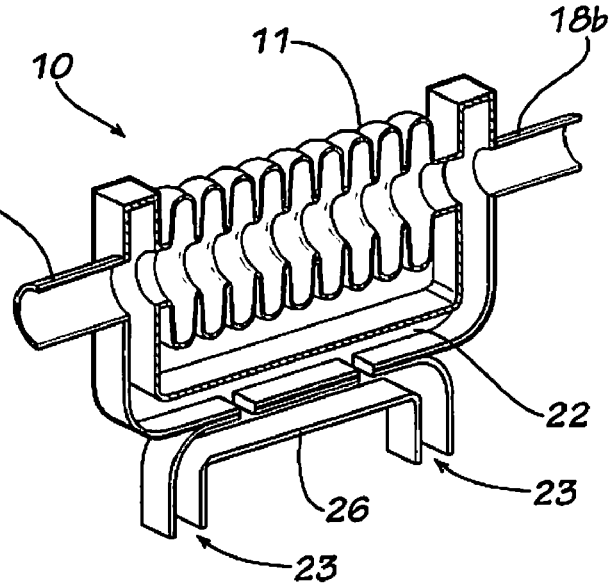
FIG. 6C depicts a perspective longitudinal cross-section view of a non-twisted waveguide connected at each end of a twisted waveguide structure according to an embodiment of the invention.

Since the resonant RF frequency of the structure 10 is determined by characteristics of the overall structure (i.e., channel dimensions and pitch), the resonant frequency can be tuned with a tuning mechanism that can change the volume by slightly moving the wall at the end of the structure. It is also possible to use a tuning/phase-shifting device disposed external to the structure 10 and in communication with an inlet/outlet. For example, as shown in FIGS. 6A, 6B, and 6C, a rectangular waveguide 22 can be integrated with the structure 10. An RF phase-shifter can be disposed in the waveguide 22 to adjust the overall resonant frequency of the structure 10. Power couplers and higher-order mode (HOM) dampers 23 (FIG. 6C) can also be disposed in the waveguide 22. The embodiments of FIGS. 6A-6C include straight circular waveguide sections 18*a*-18*b* at each end of the waveguide body 11. The embodiment of FIG. 6C includes an additional waveguide connection 26 at the bottom of the straight waveguide section 22.

Figure 5A:
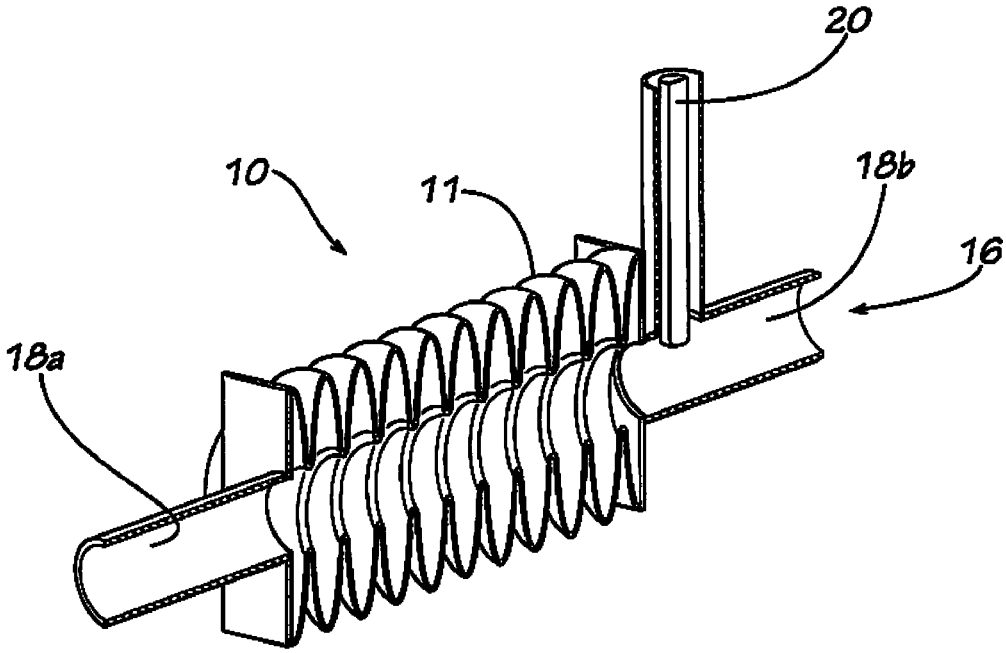
FIG. 5A depicts a perspective longitudinal cross-section view of a twisted waveguide structure with a coaxial power coupling according to an embodiment of the invention.
Figure 5B:
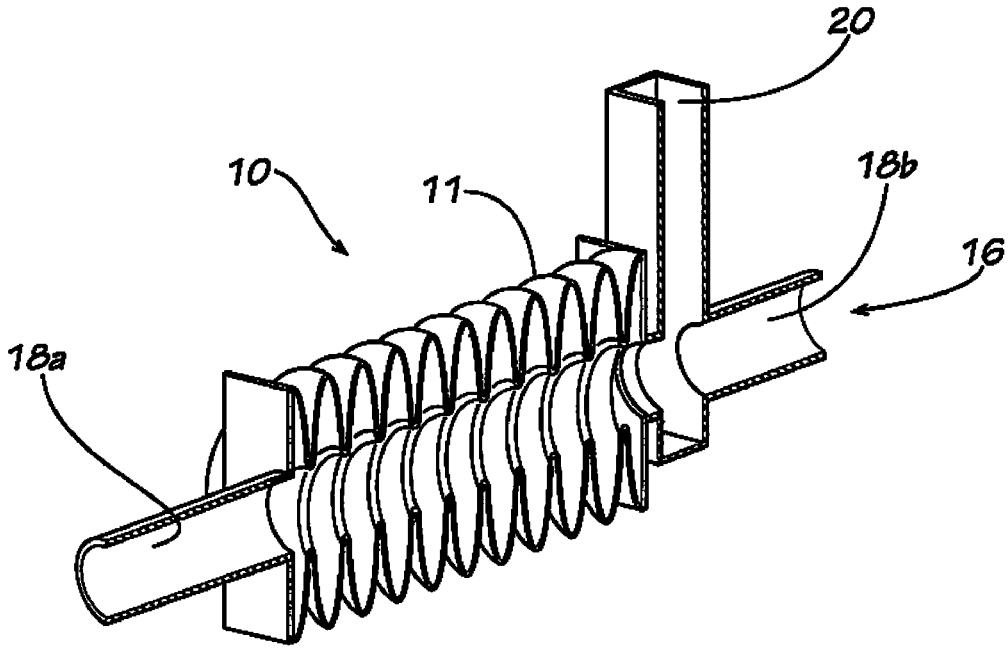
FIG. 5B depicts a perspective longitudinal cross-section view of a twisted waveguide structure with a rectangular waveguide power coupling according to an embodiment of the invention.

FIGS. 5A and 5B depict an embodiment of a twisted waveguide structure 10 incorporating a power coupler 20 which may be either a coaxial type (FIG. 5A) or rectangular type (FIG. 5B) directly connected transverse to the central axis of the waveguide body 11.

Figure 7A:
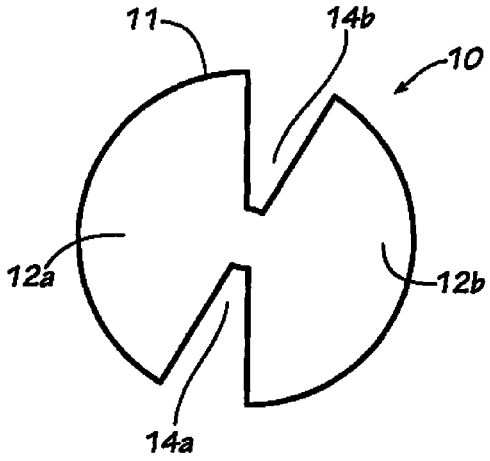
FIGS. 7A and 7B depict partial transverse views of symmetrically twisted waveguide structures according to an embodiment of the invention.
Figure 7B:
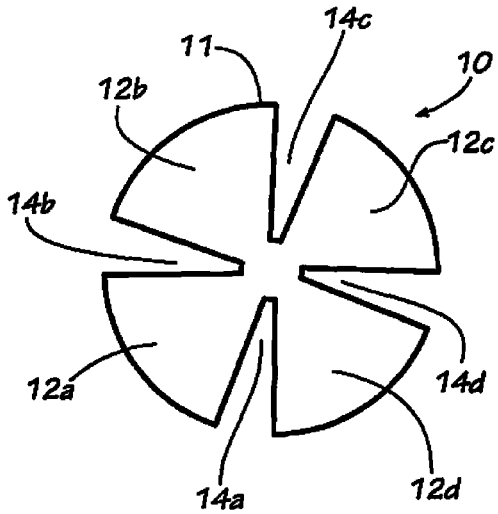
Figure 7C:
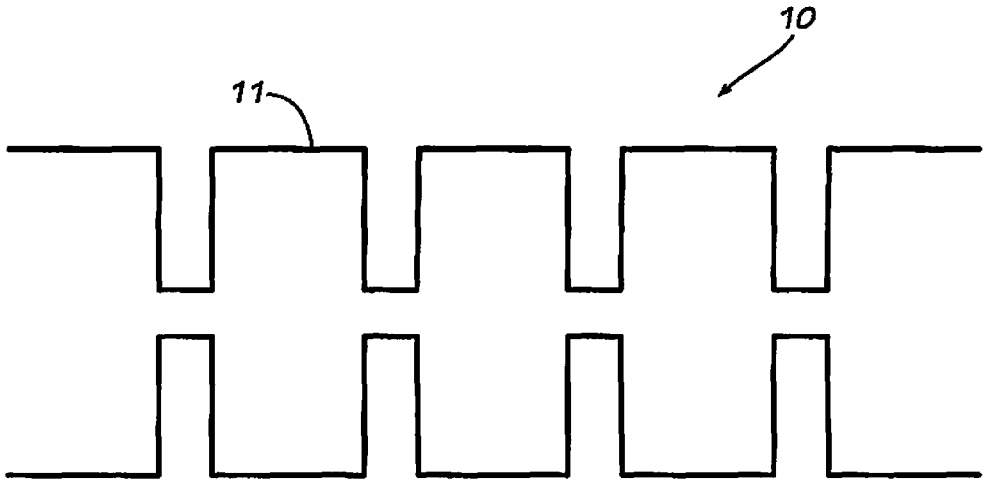
FIG. 7C depicts a partial longitudinal cross-section view of a symmetrically twisted waveguide structure according to an embodiment of the invention.
Figure 8A:
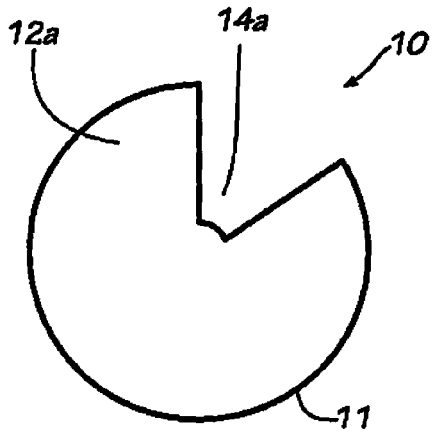
FIGS. 8A and 8B depict partial transverse views of asymmetrically twisted waveguide structures according to an embodiment of the invention.
Figure 8B:
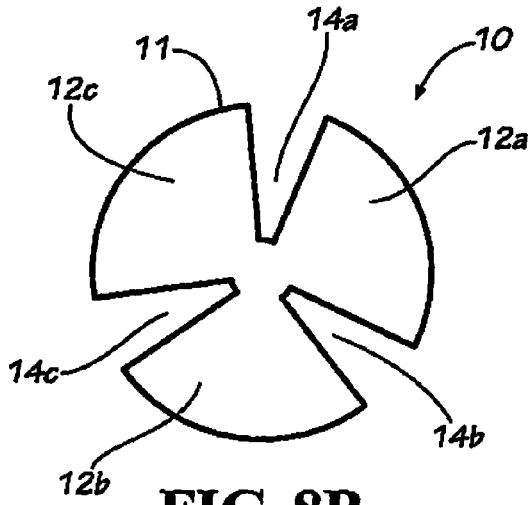
Figure 8C:
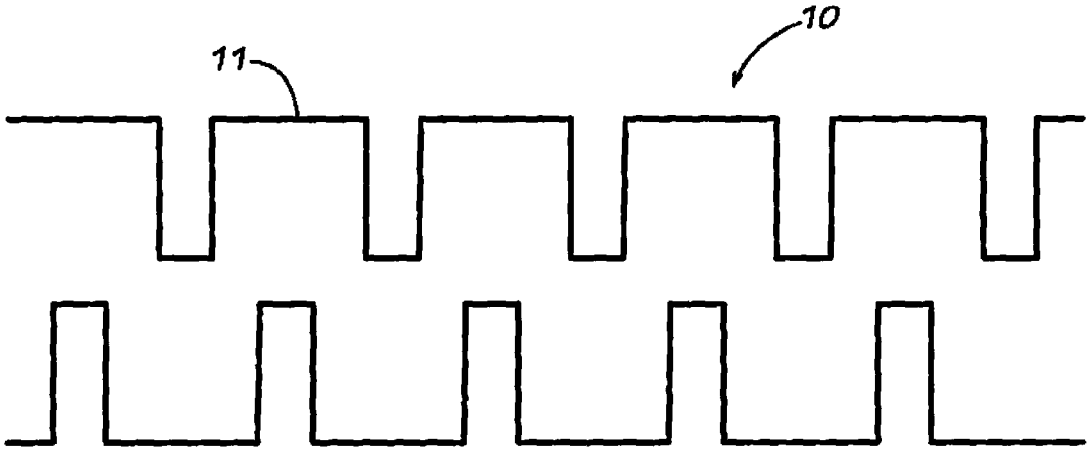
FIG. 8C depicts a partial longitudinal cross-section view of an asymmetrically twisted waveguide structure according to an embodiment of the invention.

Twisted waveguide structures generally fall into two categories: symmetrically twisted structures and asymmetrically twisted structures. As shown in FIGS. 7A-7C, waveguides having an even number of lobe structures, such as two lobe structures 14*a*-14*b* (FIG. 7A) or four lobe structures 14*a*, 14*b*, 14*c*, 14*d* (FIG. 7B), have a vertically symmetrical longitudinal cross section (FIG. 7C). As shown in FIGS. 8A-8C, waveguides having an odd number of lobe structures, such as one lobe structure 14*a* (FIG. 8A) or three lobe structures 14*a*-14*c* (FIG. 8B), have a vertically asymmetrical longitudinal cross section (as shown in FIG. 8C).

FIGS. 2A, 2B, 3, 4A and 4B depict various views of a second embodiment of a twisted waveguide structure 10. In this embodiment, the waveguide body 11 (FIGS. 2A, 2B, 3, 4A) also includes two opposing helical channels 12*a* (FIGS.

2A, 3, 4A, 4B) and 12*b* (FIGS. 2A, 3, 4A) which merge along the axis of the structure to form a central axial channel 16. As shown in the transverse cross-section view of FIG. 4A (viewed at section line E-E in FIG. 3), the channels 12*a*-12*b* are shaped as sections of a circle which are separated by opposing lobe structures 14*a*-14*b*. As shown in FIG. 2B, the structure 10 forms a corrugated pattern of grooves and ridges in the longitudinal cross-section, the longitudinal pitch of which may be characterized by the pitch angle θ.

In comparing the first embodiment (FIGS. 1A-1C) to the second embodiment (FIGS. 2A-2B, 3 and 4A-4B), the first embodiment may provide better particle beam quality, whereas the second may provide higher electrical efficiency.

Figure 9:
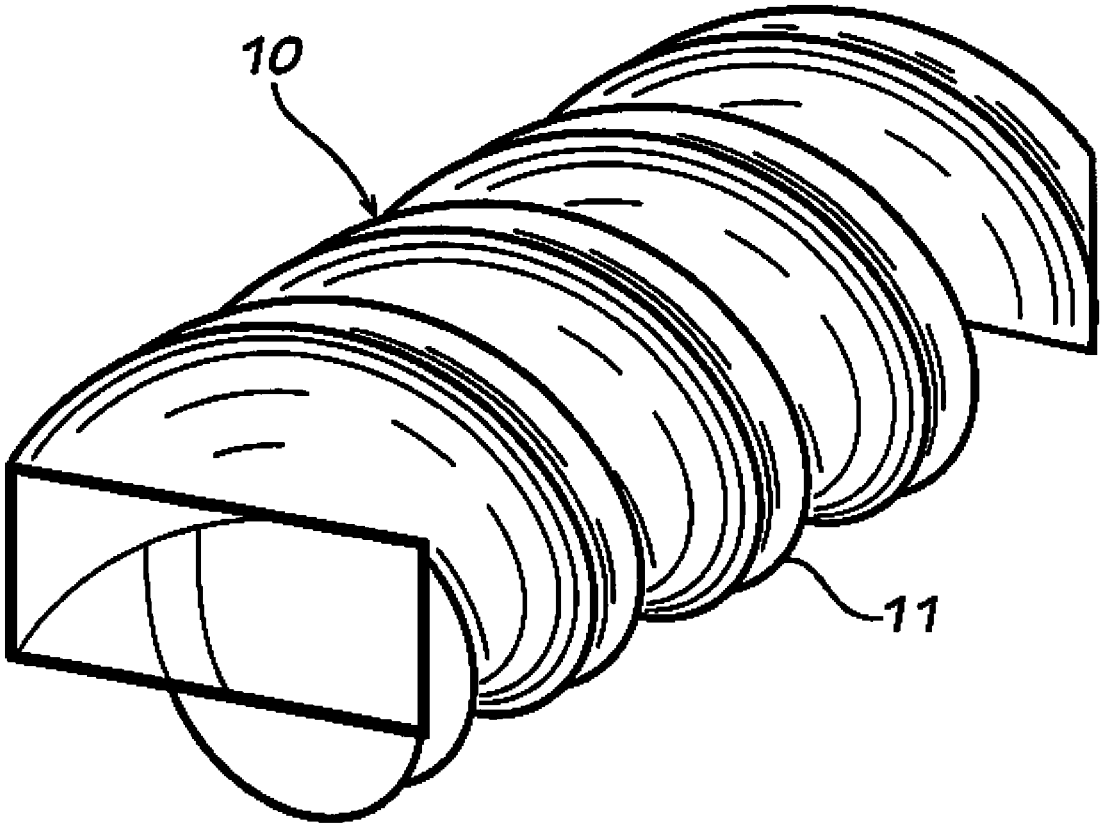
FIG. 9 depicts a perspective view of a twisted waveguide structure having a rectangular transverse cross-section according to an embodiment of the invention.

FIG. 9 depicts an alternative embodiment of a twisted waveguide structure 10 wherein the waveguide body 10 comprises a single channel having a rectangular transverse cross-section.

The twisted waveguide structures described herein are particularly suited to formation by extrusion molding. However, these structures could also be formed by injection molding or casting for example. Materials such as ferrous and nonferrous metals and their alloys, or reinforced plastics, composites and the like with metal plated inner surface may be used to form the waveguide body 11. Thus, production costs, fabrication times, and fine tuning of these structures are significantly less than doing the same with the corrugated structures manufactured by welding or brazing individual components.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. An electromagnetic waveguide structure comprising:

a waveguide body having a central axis;

at least two helical channels defined by the waveguide body, the channels twisted about one another and about the central axis, each helical channel operable to support electromagnetic wave propagation in at least one propagation mode at a propagation speed determined by a pitch rate of the at least two helical channels, wherein the pitch rate is expressed in revolutions of the helical channels per unit length along the central axis; and a substantially linear central axial channel through the waveguide body, disposed along the central axis and operable to conduct a charged particle beam, wherein portions of the at least two helical channels disposed nearest to the central axis merge with the linear central axial channel, such that the portions of the helical channels disposed nearest to the central axis are open to the linear central axial channel.

2. The electromagnetic waveguide structure of claim 1 wherein the at least two helical channels comprise more than two helical channels disposed at a substantially equiangular spacing around the central axis in a plane transverse to the central axis.

3. The electromagnetic waveguide structure of claim 1 wherein the at least two helical channels comprise two helical channels disposed on opposing sides of the central axis, each helical channel having a substantially elliptically-shaped cross-section in a plane transverse to the central axis.

4. The electromagnetic waveguide structure of claim 1 wherein the at least two helical channels comprise two helical channels disposed on opposing sides of the central axis, each helical channel having a cross-section shaped as a portion of a circle in a plane transverse to the central axis.

5. The electromagnetic waveguide structure of claim 1 further comprising a rectangular waveguide section coupled to the central axial channel at opposing ends thereof.

6. The electromagnetic waveguide structure of claim 1 formed by a process selected from the group consisting of extrusion molding, injection molding and casting.

7. The electromagnetic waveguide structure of claim 1 further comprising at least one straight waveguide section aligned coaxially with the central axis and coupled to at least one end of the central axial channel and operable to conduct the charged particle beam.

8. The electromagnetic waveguide structure of claim 7 further comprising a power coupler connected to the at least one straight waveguide section and aligned substantially perpendicular to the central axis.

9. An electromagnetic waveguide structure comprising:

a waveguide body having a central axis;

a substantially linear central axial channel disposed through the waveguide body along the central axis and operable to conduct a charged particle beam, a first helical channel defined by the waveguide body and disposed about the central axial channel, the first helical channel operable to support electromagnetic wave propagation in a transverse magnetic propagation mode, wherein a central portion of the first helical channel disposed nearest to the central axis is open to the linear central axial channel; and a second helical channel defined by the waveguide body and disposed about the central axial channel radially opposite the first helical channel, whereby the second helical channel intertwines with the first helical channel such that the first and second helical channels are twisted about one another, the second helical channel operable to support electromagnetic wave propagation in the transverse magnetic propagation mode, wherein a central portion of the second helical channel disposed nearest to the central axis is open to the linear central axial channel.

10. The electromagnetic waveguide structure of claim 9 wherein the first and second helical channels each have a substantially elliptically-shaped cross-section in a plane transverse to the central axis.

11. The electromagnetic waveguide structure of claim 9 wherein the first and second helical channels each have a cross-section shaped as a section of a circle in a plane transverse to the central axis.

12. The electromagnetic waveguide structure of claim 9 formed by a process selected from the group consisting of extrusion molding, injection molding and casting.

* * * * *